US009279224B2

(12) United States Patent
Waters, Jr.

(10) Patent No.: US 9,279,224 B2
(45) Date of Patent: Mar. 8, 2016

(54) SELF-ACTUATING SHORELINE FLOOD GUARD

(71) Applicant: Floodbreak, L.L.C., Houston, TX (US)

(72) Inventor: Louis A. Waters, Jr., Bellaire, TX (US)

(73) Assignee: Floodbreak, L.L.C., Houston, TX (US)

( * ) Notice: Subject to any disclaimer, the term of this patent is extended or adjusted under 35 U.S.C. 154(b) by 101 days.

(21) Appl. No.: 14/076,657

(22) Filed: Nov. 11, 2013

(65) Prior Publication Data

US 2014/0169883 A1 Jun. 19, 2014

Related U.S. Application Data

(62) Division of application No. 12/851,308, filed on Aug. 5, 2010, now abandoned.

(51) Int. Cl.

| | |
|---|---|
| ***E02B 3/10*** | (2006.01) |
| ***E02B 7/20*** | (2006.01) |
| ***E02B 7/44*** | (2006.01) |
| ***E02B 7/54*** | (2006.01) |

(52) U.S. Cl.

CPC ..... *E02B 3/104* (2013.01); *E02B 7/205* (2013.01); *E02B 7/44* (2013.01); *E02B 7/54* (2013.01)

(58) Field of Classification Search

USPC ..... 405/92

See application file for complete search history.

(56) References Cited

U.S. PATENT DOCUMENTS

| | | | | |
|---|---|---|---|---|
| 4,377,352 | A | 3/1983 | Goodstein | |
| 6,623,209 | B1 * | 9/2003 | Waters, Jr. | 405/94 |
| 7,121,764 | B2 * | 10/2006 | Rorheim | 405/107 |
| 2009/0185864 | A1 * | 7/2009 | Waters, Jr. | 405/96 |

FOREIGN PATENT DOCUMENTS

| | | | |
|---|---|---|---|
| DE | 10162568 | A1 | 7/2003 |
| GB | 2399375 | A | 9/2004 |
| GB | 2425559 | A * | 11/2006 |
| GB | 2457463 | A | 8/2009 |
| JP | 10-152827 | | 9/1998 |
| JP | 2001-214425 | | 7/2001 |
| JP | 2003-221822 | | 8/2008 |
| WO | 2006/120410 | A1 | 11/2006 |

* cited by examiner

*Primary Examiner* — Benjamin Fiorello
*Assistant Examiner* — Kyle Armstrong
(74) *Attorney, Agent, or Firm* — Tim L. Burgess, P.C.

(57) ABSTRACT

A series of self-actuating flood guard units each including a buoyant gate flanked by a pair of the boundary walls and pivotable about a horizontal axis transverse to the flanking boundary walls runs along a shoreline of an adjacent body of water The axis is located at a selected elevation above ground inundated by the body water and is selected to cause the gate to buoyantly rotate upwardly between the boundary walls on rise of water above the selected elevation. The extent of rotation is limited by a restraint acting on the gate. The series of units may be continuous or contiguous and act as a whole to prevent onshore flooding from a rise of the body of water at the shoreline.

10 Claims, 7 Drawing Sheets

SELF-ACTUATING SHORELINE FLOOD GUARD

CROSS-REFERENCE TO RELATED APPLICATIONS

This application claims priority to U.S. Non-Provisional application Ser. No. 12/851,308, filed Aug. 5, 2010, the entirety of the contents of which are incorporated herein by reference.

STATEMENT REGARDING FEDERALLY SPONSORED RESEARCH AND DEVELOPMENT

Not Applicable

BACKGROUND OF THE DISCLOSURE

1. Field of Disclosure

This invention relates to flood guards for constructions.

2. Background

Doors and other grade level openings have been guarded from entrance of water by gates that are self-actuating. See U.S. Pat. Nos. 6,623,209 and 7,101,114, by the inventor of the invention described herein. Riverbanks have been described lined by self-elevating stanchions using interconnected flexible sheeting between stanchions to provide a water containment barrier. See U.S. Pat. No. 4,377,352.

Floodwaters are a major source of property damage. Floodwaters may come from waters rising from a body of water, such as a hurricane driven storm surge, from swollen rivers rising above flood stage from snow melt or heavy rains, or from waters accumulating and rising at ground surface due to sustained rains overwhelming drainage systems. A need continues to exist for preventing floodwaters inundating or infiltrating buildings and other constructions.

Buildings on the shore of a body of water are especially vulnerable. Solutions that propose permanent erection of fabricated steel or concrete walls or levees at a shore side to hold back storm surge or other rising floodwaters are costly, and even if feasible, permanently mar the landscape of often beautiful areas and block the desired open view of and hinder access to the body of water that attracted the erection of the buildings near the body of water in the first place. Sometimes even such costly and undesirable solutions are infeasible. There may be no space available for permanent improvements such as fixed walls or levees between the buildings and the shoreline due to zero-line building at bulkheads and seawalls. In other words, sometimes buildings are right on the seawall or bulkhead, and sometimes there is no space to put a levee, which typically needs to be twice as wide as tall.

BRIEF DESCRIPTION OF THE DRAWINGS

In the following detailed description of exemplary embodiments, reference is made to the accompanying drawings, which form a part hereof and in which are shown by way of illustration examples of exemplary embodiments with which the invention may be practiced. In the drawings and descriptions, like or corresponding parts are marked throughout the specification and drawings with the same reference numerals. The drawings are not necessarily to scale. Certain features of the invention may be shown exaggerated in scale or in somewhat schematic form and some details of conventional elements may not be shown in the interest of clarity and conciseness. Referring to the drawings.

DETAILED DESCRIPTION OF EMBODIMENTS

Figure 1:
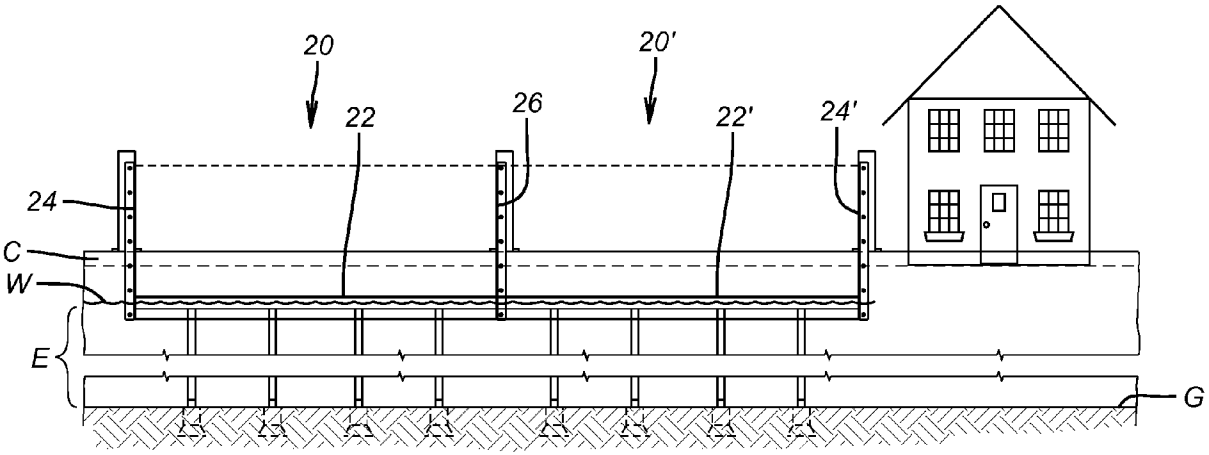
FIG. 1 is an end elevational view of an exemplary embodiment of the invention, showing units of the embodiment installed in a continuous series of units at a construction adjacent a shoreline of a shore.

Specific details described herein, including what is stated in the Abstract, are in every case a non-limiting description and exemplification of embodiments representing concrete ways in which the concepts of the invention may be practiced. This serves to teach one skilled in the art to employ the present invention in virtually any appropriately detailed system, structure or manner consistent with those concepts. Reference throughout this specification to "an exemplary embodiment" means that a particular feature, structure, or characteristic described in connection with the embodiment is included in at least one exemplary embodiment of the present invention. Thus, the appearances of the phrase "in an exemplary embodiment" or similar expression in various places throughout this specification are not necessarily all referring to the same embodiment. Further, the particular features, structures, or characteristics may be combined in any suitable manner in one or more embodiments. Various changes and alternatives to the specific described embodiments and the details of those embodiments may be made within the scope of the invention. One or more of the elements depicted in the drawings can also be implemented in a more separated or integrated manner, or even removed or rendered as inoperable in certain cases, as is useful in accordance with a particular application. Because many varying and different embodiments may be made within the scope of the inventive concepts herein described and in the exemplary embodiments herein detailed, it is to be understood that the details herein are to be interpreted as illustrative and not as limiting the invention to that which is illustrated and described herein.

The various directions such as "upper," "lower," "back," "front," "transverse," "perpendicular", "vertical", "horizontal," "length," "height", "width," "laterally", "proximal", "distal" and so forth used in the detailed description of exemplary embodiments are made only for easier explanation in conjunction with the drawings. The components may be oriented differently while performing the same function and accomplishing the same result as the exemplary embodiments herein detailed embody the concepts of the invention, and such terminologies are not to be understood as limiting the concepts which the embodiments exemplify.

As used herein, the use of the word "a" or "an" when used in conjunction with the term "comprising" (or the synonymous "having" or "including") in the claims and/or the specification may mean "one," but it is also consistent with the meaning of "one or more," "at least one," and "one or more than one."

In addition, as used herein, the phrase "connection to" or "connected to" means joined to, either directly or through intermediate components. The word "ground" means a surface or floor to which an improvement is constructed. A "construction" may be any improvement built on or in the earth. In the embodiments herein described, the exemplified constructions, without limitation, are a wall, such as a bulkhead, lining a shoreline the normally exposed parts of which are spaced from ground on the water side of the bulkhead normally inundated by a body of water (if tidal, except at low tide). The body of water, for example, may be a stream, a canal, a river, a pond, a lake, an estuary, a bay or an ocean.

Referring to FIGS. 1-10, exemplary embodiments of a self-actuating flood guard unit 20 for a construction are illustrated. FIGS. 1-10 illustrate an embodiment of a flood guard unit 20 which, deployed in a series, can be used to provide a shoreline defense against a rising body of water. The exemplary embodiment is for installation (and here, shown installed) at a construction "C", for example, a low wall (here a bulkhead) lining a shore "S" at a shoreline of a body of water "W".

Figure 3:
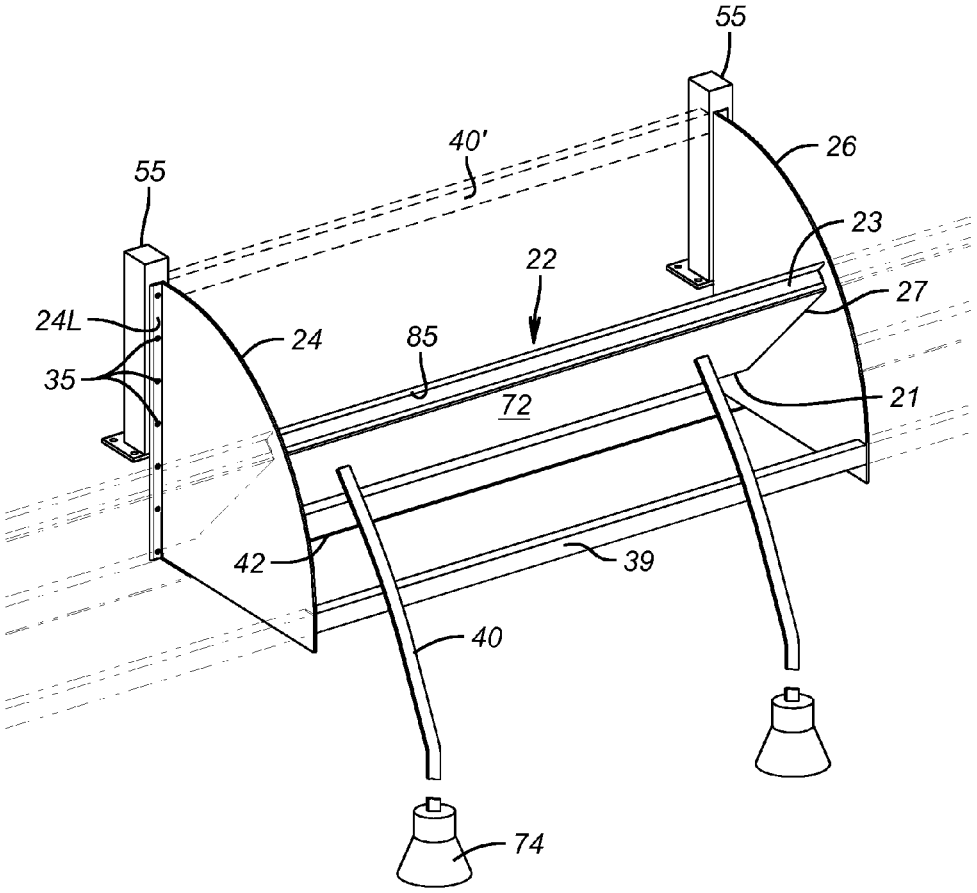
FIG. 3 is a perspective view of the embodiment of FIG. 1, showing adjacent units in dashed line.
Figure 4:
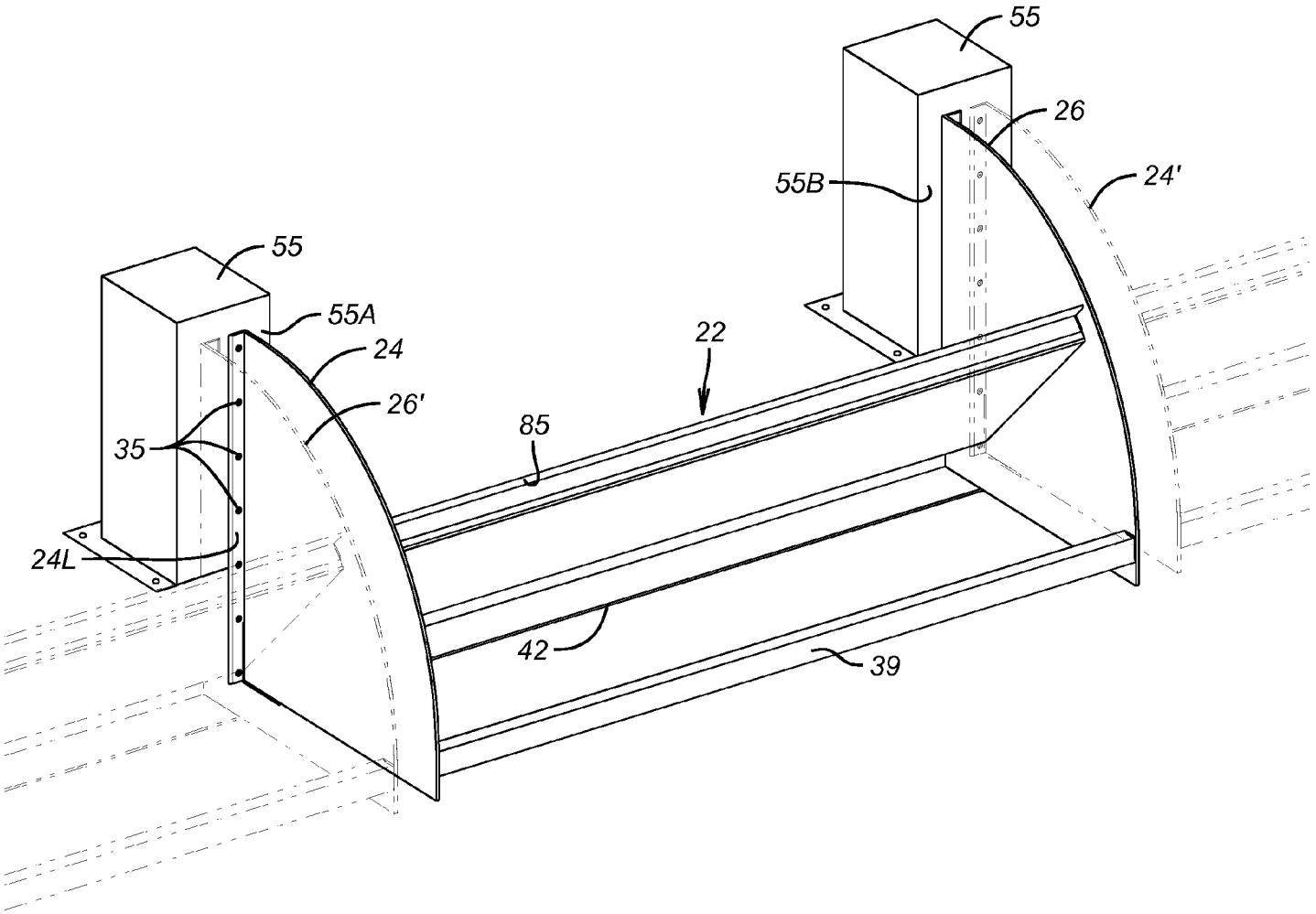
FIG. 4 is a perspective view of another exemplary embodiment showing an alterative arrangement of the units showing adjacent units in dashed line, as adjacent a shoreline of a shore.
Figure 5:
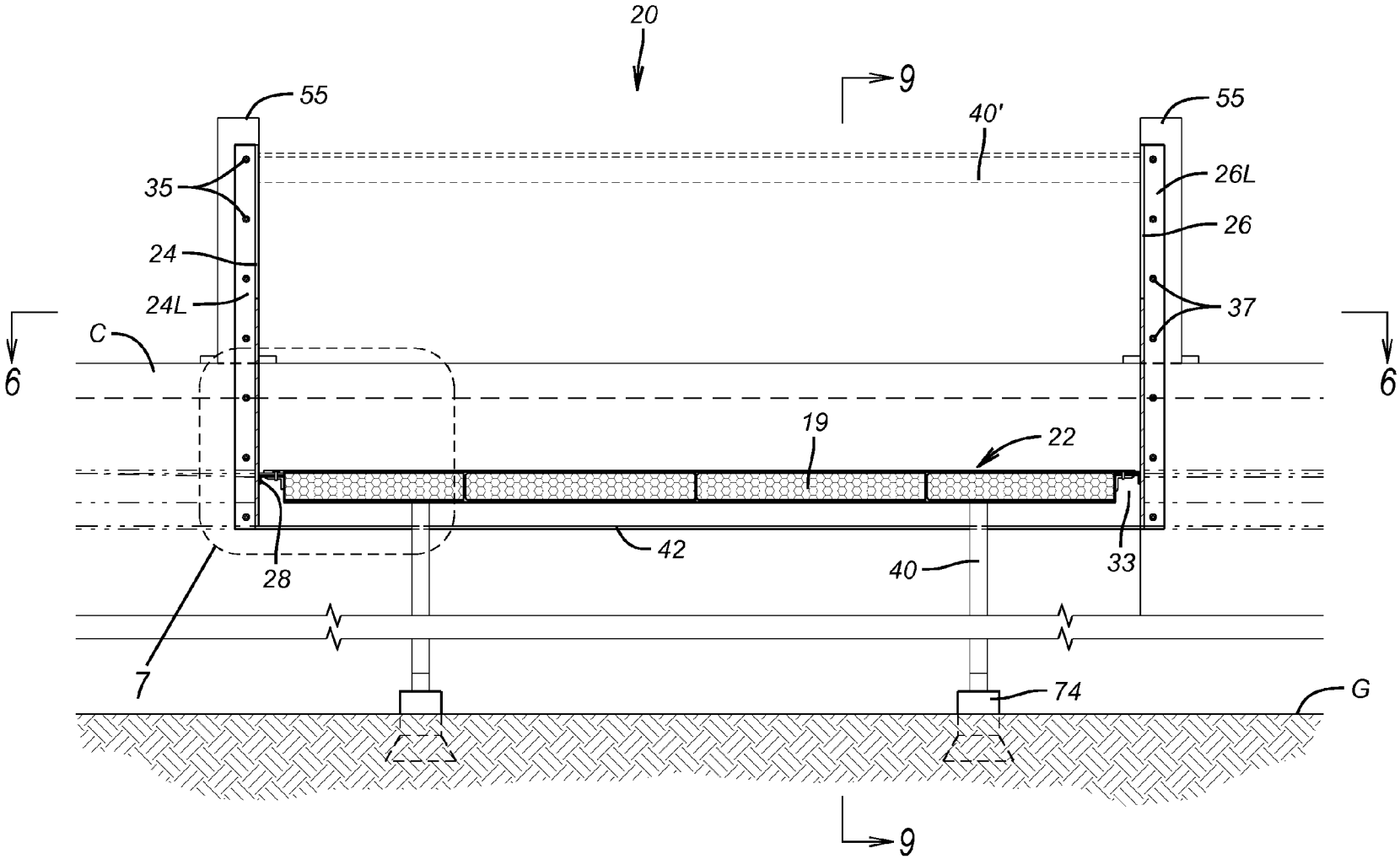
FIG. 5 is a sectional view of the exemplary embodiment of FIG. 1 taken along the line 5-5 in FIG. 6.

Referring to FIGS. 3-5 in particular, a buoyant gate 22 has a base at a proximal side or end 21, a top at a distal side or end 23, lateral sides 25, 27, a height 29 from the proximal end 21 to distal end 23 and a width 31 between lateral sides 25, 27. The gate comprises buoyant material, for example, it may comprise a plurality of sealed tubes arranged side by side, or a honeycomb core structure sealingly arranged between two rigid panels, as shown at reference numeral 19 in the sectional views of FIGS. 5, 7-10. Alternatively the gate may comprise a bladder for a flotation material.

A first vertical boundary wall 24 is adapted for connection to the construction, for example, as by a flange 24L outturned at one end of the wall. A second vertical boundary wall 26 similarly adapted for connection to the construction, by flange 26L outturned at an end of wall 26, substantially parallel to first boundary wall 24, spaced from first boundary wall 24 a distance at least sufficient to accommodate the width of the gate.

As depicted, boundary wall 26 is spaced from first vertical boundary wall 24 a distance wider than the width 31 of gate 22 sufficient to provide a gap 33 between each lateral side 25, 27 of gate 22 and the adjacent boundary wall 24, 26 suitable for accommodation of a flexible lip seal gasket 28 (described below) for sealing the gap 33.

Figure 2:
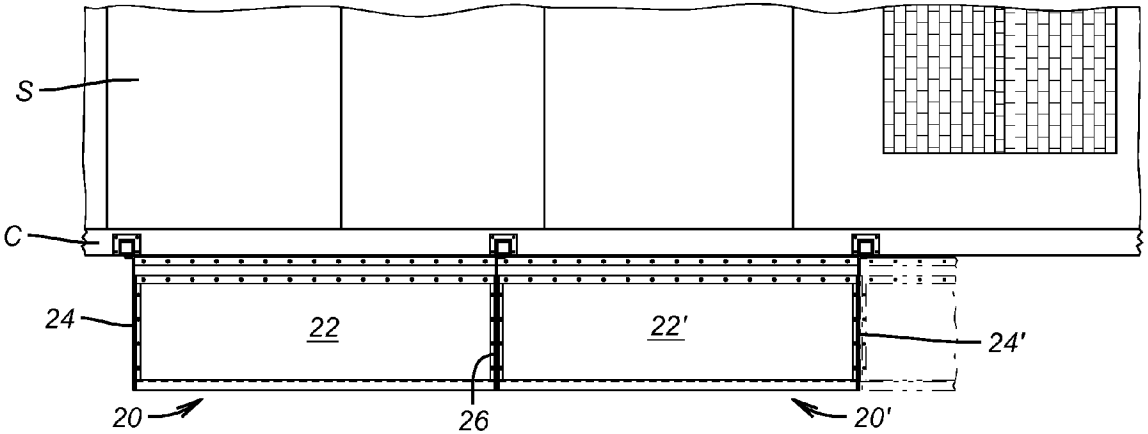
FIG. 2 is a top plan view of the exemplary embodiment of FIG. 1, also showing units of the embodiment installed in a continuous series of units at a construction adjacent a shoreline of a shore.

In an embodiment depicted in FIGS. 1, 2 and 3 for installation (and shown installed) at a construction adjacent a shoreline "S" of a shore of a body of water "W", a continuous series of flood guard units 20, 20' are employed in which one vertical boundary wall 24 provides a first end wall to the series, another boundary wall 24' provides a second end wall to the series, and at least one intermediate boundary wall 26 is located between the end walls 24, 24'. A first end gate 22 is located between the first end wall 24 and a next adjacent intermediate boundary wall 26, and a second end gate 22' is located between a second end wall 24' and a next adjacent intermediate boundary wall 26. Boundary wall 26 is common to the flood guard units 20, 20' and serves both first end gate 22 and second end gate 22'. This deployment is referred to as a continuous series.

The embodiments shown in FIGS. 1 and 2 show only two of flood guard units 20 side by side. These are exemplary of a number of repeating such units connected side by side. Deploying a series of the units 20 end to end on one or both sides of end boundary walls 24, 24' shown in FIGS. 1-2 converts at least one of the two initial end boundary walls 24, 24' to an intermediate boundary wall 26' and, after adding together a number of the units 20, eventually results in terminating end boundary walls 24 or 24' (build from end only) or 24 and 24' (build from both ends) for the terminating units 20. Thus the expression "next adjacent boundary wall" 26 refers to one or more boundary walls 26, 26' etc. intermediate terminal end walls 24, 24' in a continuous series of flood guard units deployed side by side to defend a shoreline, and further, gates 22 will be interposed between adjacent intermediate boundary walls 26, 26' as well as between a terminal end boundary wall 24 or 24' and the next adjacent intermediate boundary wall 26 or 26'.

Referring to FIG. 4, a variation on the foregoing manner of deploying flood guard units 20 in a series as a defense against flooding is depicted. In this embodiment, there is no common boundary wall. Each contiguous flood guard unit 20 has a full set of boundary walls 24, 26. This deployment is referred to as a contiguous series. A plurality of flood guard units 20 thus comprises a contiguous series of said units arranged side by side in which next adjacent boundary walls of next adjacent units 20, e.g. boundary wall 26 of unit 20 and a next adjacent boundary wall 24' of next adjacent unit 20' are connected to a riser 55 rising from a construction "C" lining the shoreline. The Risers block and water rising between the adjacent walls 26, 24'.

Figure 6:
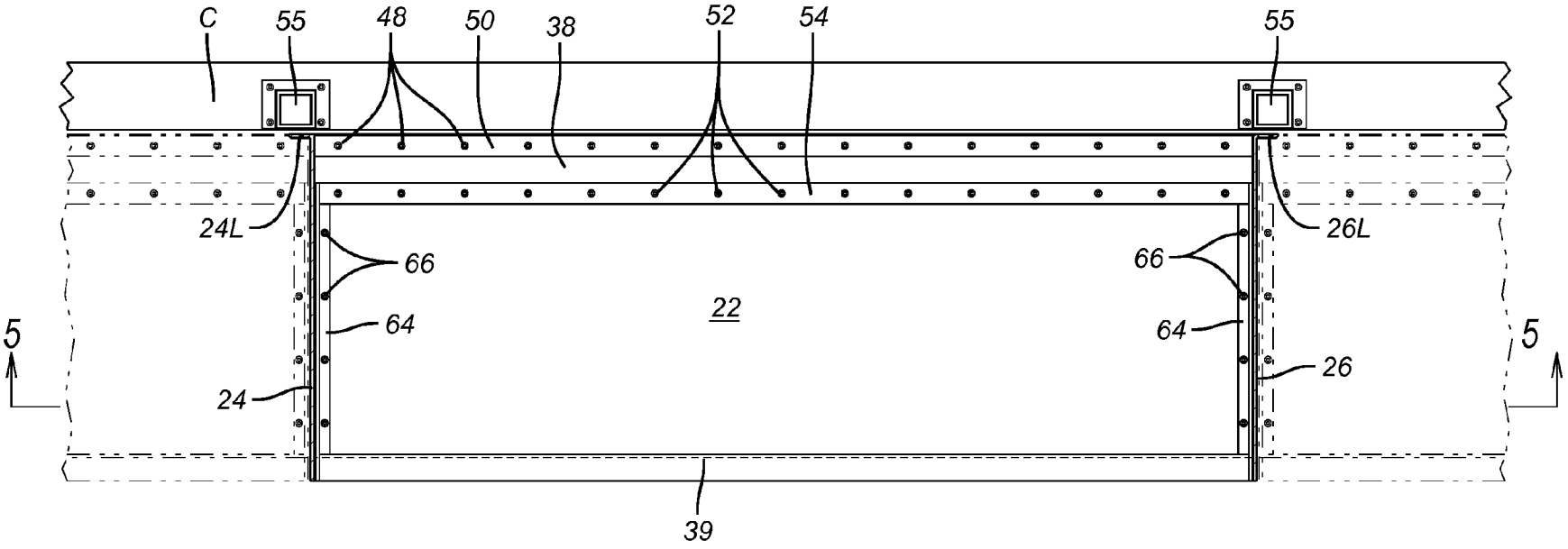
FIG. 6 is a top plan view taken along the line 6-6 in FIG. 5 and expanding on a portion of the view of FIG. 2.
Figure 8:
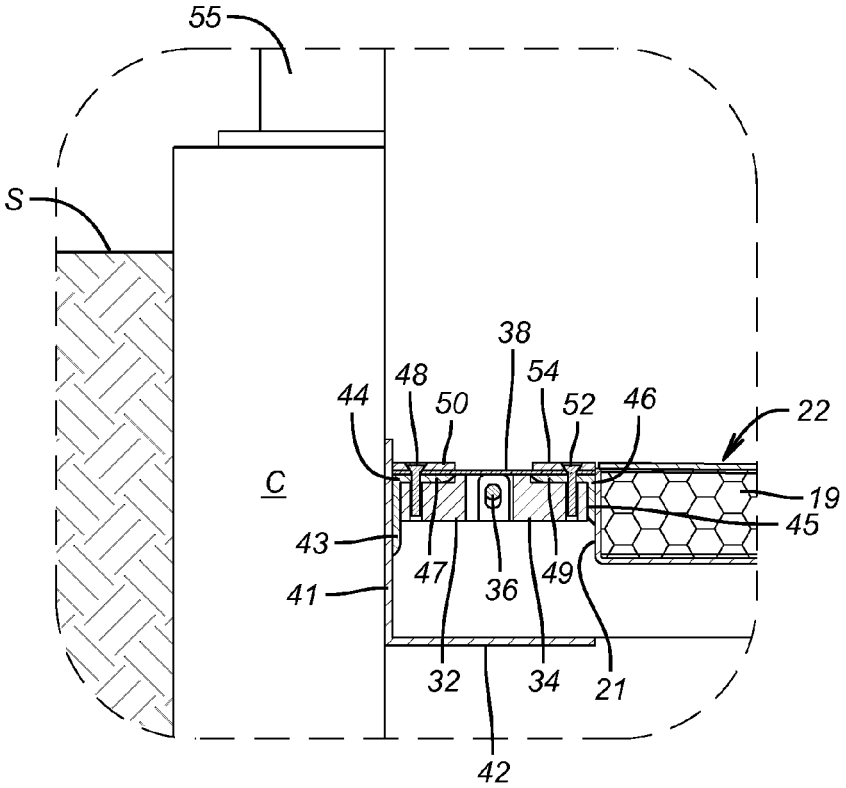
FIG. 8 an enlargement of the portion of FIG. 9 indicated by dashed line outline and indicated by numeral 8.
Figure 10:
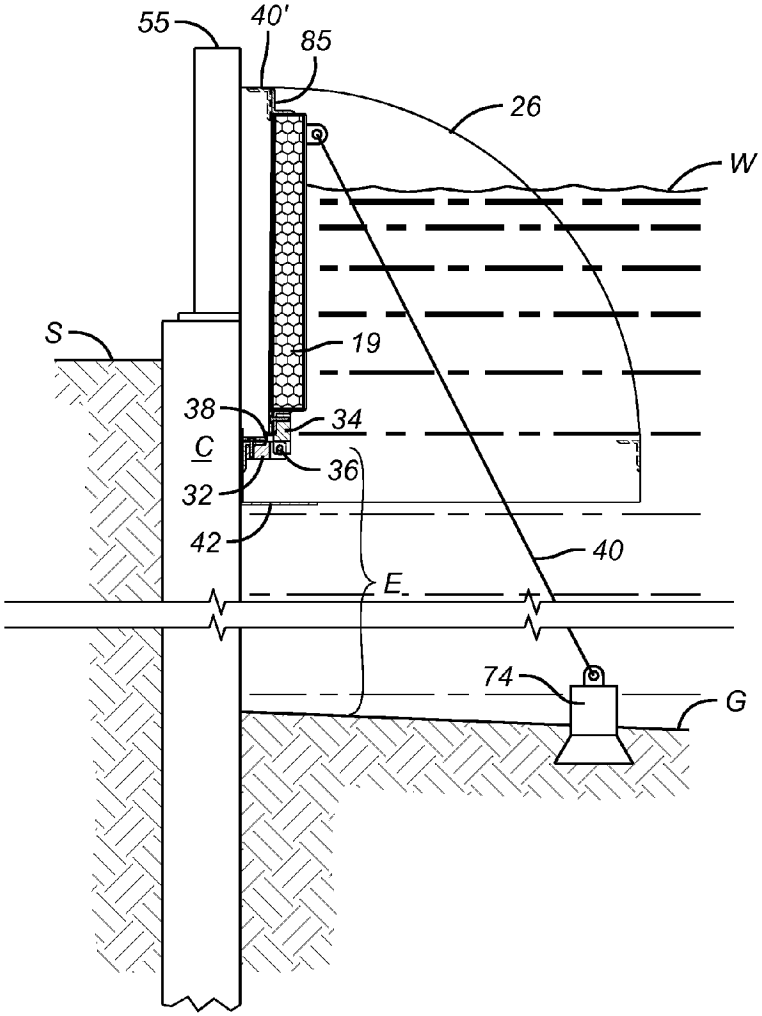
FIG. 10 is a side sectional view the same as FIG. 9 showing the flood guard gate in elevated position occasioned by rise of the body of water.
Figure 9:
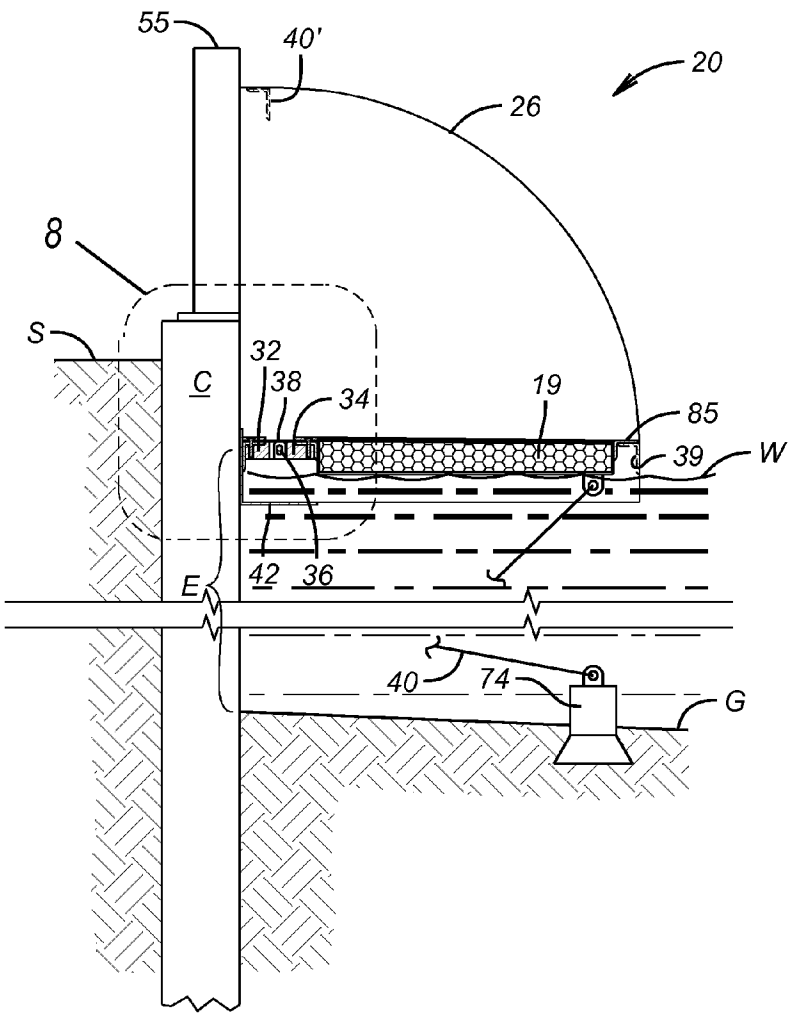
FIG. 9 is a side sectional view taken along the line 9-9 in FIG. 5 and shows the flood guard gate in normal un-elevated position floating on a body of water.

Referring particularly to FIG. 6 for orientation, FIG. 8 for detail, and FIGS. 9-10 for depiction of change in disposition of gate 22 from horizontal to vertical, pivotation members comprising a stationary member 32 adapted for connection to construction "C" and a movable member 34 movably joined to the stationary member 32 at a horizontal axis 36 normal to boundary wall 24, 26. Movable member 34 is connected to proximal side 21 of gate 22 and is pivotable about axis 36. The connected and joined pivotation members 32, 34 locate the proximal side 21 of gate 22 at a selected elevation "E" spaced from normally inundated ground "G" (see "G" in FIGS. 1, 8-9 and 10) for pivotation of gate 22 swinging the distal end 23 of the gate upwardly (FIGS. 8-9) on rise of water "W" above elevation "E."

On rise of water "W" sufficient to float gate 22 above elevation "E", the gate is buoyed and by force of rising water (hydrostatic pressure) is rotated upwardly about the pivot axis 36. Before the gate rotates past 45 degrees, more of the hydrostatic pressure is "lifting" the gate. After 45 degrees, more of the hydrostatic pressure is pushing against the back face of gate 20 to close it. The result is a continuous curve of forces that first balance the gate in a partially raised position against gravity pressing the gate against the pivot axis 36, and eventually, at something about ⅓ to ½ the total height of the gate, overcomes the weight of the gate and pushes it fully closed. The total weight, displacement and size of the gate moves the "rotation point" up or down the curve of forces. Gate closure is maintained by impress of hydrostatic pressure until the water level subsides and the force of gravity takes over to lower the gate.

Referring particularly to FIG. 5 for orientation and FIG. 7 for detail as further described below, flexible lip seal gaskets 28 along a length of the lateral sides 25, 27 of gate 22 are of width sufficient to sealingly wipe boundary walls 24, 26 to seal gaps 33. Although the embodiment depicted includes lip seal gaskets 28, they may be omitted. In a full flood (gate 20 fully raised), without the presence of gaskets 28 wiping and sealing the boundary walls, a slight vertical slice of water would exist at each lateral edge of the gate verses a very large horizontal mass of water refused across the whole face of the gate. Depending on the overall width of the gate, the reduction of water flow onto the shore is orders of magnitude greater than the small slice of water flowing through the margins at the edge of the gate adjacent the boundary wall. For protection of a shoreline, such "leakage" at the margins of the gate is trivial compared to the protection gained against the large mass of water blocked by the gate. Thus, if the lip seals were degraded over time, or even if not present in the first place, most improvements guarded by the gate would be sufficiently protected.

Referring particularly to FIG. 6 for orientation, and to FIG. 8 for detail further described below, a flexible strip gasket 38 is along the width 31 of gate 22 at the proximal side 21 of gate 24 spanning across pivotation members 32, 34. Strip gasket 38 prevents passage of water between the construction "C" and the proximal side 21 of gate 22, and lip gaskets 28 prevent passage of water through gaps 33 when water rises sufficiently above elevation "E" to buoy gate 22 rotationally upward about pivotation axis member 32 between boundary walls 24, 26.

Referring particularly to FIGS. 1, 3, 9-10 respecting the embodiments adapted for installation (and shown installed) at a construction "C" adjacent a shoreline of a shore "S" of a body of water "W", a restraint 40 acting on gate 22 prevents gate 22 from rotating about axis 36 more than a predetermined extent when gate 22 is rotationally raised upwardly above elevation "E." In the embodiments shown, the predetermined extent is vertical, but more or less than vertical may be permissible in some installations. In the embodiments shown in FIGS. 1, 3, 9 and 10, restraint 40 is a tension member, such as a chain or cable, anchored as by a piling 74 to the inundated ground "G" under the body of water "W." Optionally, instead of tension members, restraint 40 may be a horizontal stringer 40' (shown in dashed lines in FIGS. 1, 3 and 5) connected to risers 55 of construction "C" a distance above horizontal axis 36 allowing gate 22 to rotate to a substantially vertical orientation. Risers 55 are separated by more than the width 31 of gate 22. Restraints 40 (or '40) oppose and counter bending moments that otherwise would be impressed on the width of gate 22 by the forces of wave action or a storm surge driving water against gate 22 in its elevated position that, at least for a fairly wide gate, would not be sufficiently prevented by restraints applied only against the lateral edges 25, 27 of gate 22. Compared to horizontal stringer 40', tensioned members 36 provide the advantage of not interfering with or cluttering a view of a body of water by an on-shore observer near the shoreline when gates 22 are reposed in normal horizontal position.

Referring to FIGS. 3, 4, 6, 9 and 10 in the embodiments for shoreline defense, an optional brace 39 spans across paired boundary walls 24, 26 at the foot of the walls distal from horizontal axis 36. Gate 22 optionally includes an L-shaped flange 85 at distal top end 23. At rest, gate 22 in the installation shown in FIGS. 1, 5 and 9 floats on the water. The distal top end 23 of gate 22 may dip down as water level "W" drops, and needs no brace to stop the descent of distal end 23 and support the gate. However, brace 39 is useful to maintain parallel orientation of the paired boundary walls 24, 26 and the clearance of gaps 33. Optional flange 85 provides an extended gate surface for contacting optional horizontal stringer 40' in the embodiments of FIGS. 1-10 rather than having the front face of gate 22 contact stringer 40'.

In addition to shore defense against water rising from an adjacent body of water, flood guard unit 20 installed at a shoreline provides double duty when in repose: it makes a fine fishing pier and diving platform. In this sense, brace 39 and flange 85 are advantageously included as part of unit 20, adding support for the gate and people on the gate for recreational use of the gate at waterside.

The foregoing general description of the embodiments is now supplemented by a more detailed description of the embodiments shown in FIGS. 1-10. Some details are adequately explained already and are not repeated.

Referring now to FIGS. 1-10, a series of contiguous self-actuating flood guard units 20, 20' are installed for protecting a shore "S" from flooding on rise of an adjacent body of water "W" above a bulkhead wall construction "C" lining the shore. Each unit comprises buoyant gate 22 having proximal side 21, distal side 23, lateral sides 25 and 27, a height 29 from the proximal to distal sides 21, 23, and a width 31 between lateral sides 25, 27. First vertical boundary wall 24 is directly connected at flange 24L to the bulkhead wall construction "C" by fasteners 35. Second vertical boundary wall 26 is directly connected at flange 26L by fasteners 37 to bulkhead wall construction "C", spaced from first vertical boundary wall 24 a distance wider than the width 31 of gate 33 providing a gap 33 between each lateral side 25 and 27 of gate 22 and the adjacent boundary wall 24 or 26 suitable for accommodation of flexible lip seal gasket 28 for sealing gap 33.

Referring particularly to FIG. 8, a horizontal L-shaped frame member 42 is attached by vertical leg 41 to construction bulkhead wall "C". A first L-shaped flange 44 having a length the same as the width of gate 22 is attached by a vertical leg 43 of flange 44 to vertical leg 41 of frame member 42. A second L-shaped flange 46 also having a length the same as the width of gate 22 is attached at second flange vertical leg 45 to the base or proximal end 21 of gate 22. A flexible strip gasket 38 is disposed over the horizontal legs 47, 49 respectively of, and along the length of, L-shaped flange members 44, 46. A first flat band 50 having the same length as the width of gate 22 is arranged over strip 38 longitudinally atop horizontal leg 47 of flange 44. Threaded fasteners 48 pass consecutively through passages in a first flat band 50, strip 38, and horizontal leg 47 of first L-shaped flange 44, thence into a drilled and tapped stationary pivotation member 32 (one or more than one member 32) to fasten strip 38 and stationary pivotation member(s) 32 to horizontal leg 47 of first L-shaped flange 44 attached at its vertical leg 43 to vertical leg 41 of horizontal L-shaped frame member 42, thereby securing strip 38 and pivotation member 32 to horizontal L-shaped frame member 42. A second flat band 54 having the same length as the width of gate 22 is arranged over strip 38 longitudinally atop horizontal leg 49 of L-shaped flange 46. Threaded fasteners 52 pass consecutively through passages in second flat band 54, strip 38, and horizontal leg 49 of second L-shaped flange 46, thence into a drilled and tapped into drilled and tapped movable pivotation member 34 (one or more than one) to attach movable pivotation member 34 to horizontal leg 49 of second L-shaped flange 46 and secure strip 38 and movable pivotation member(s) 34 to horizontal leg 49 of second L-shaped flange 46 attached at its vertical leg 45 to the proximal side 21 of gate 22, thereby securing strip 38 and pivotation member 32 to gate 22. Movable pivotation member 34 is movably joined to stationary member 32 pivotable about horizontal axis 36 normal to boundary walls 24, 26.

Referring particularly to FIGS. 8, 9 and 10, the connection of pivotation members 32, 34 to construction "C" via horizontal L-shaped frame member 42 and first L-shaped flange 44 joined to second L-shaped flange 46 attached to the proximal side 21 of gate 22 locates the proximal side 21 of gate 22 between boundary walls 24, 26 at a selected elevation "E" spaced from earth "G" normally inundated on the water side of bulkhead construction "C", for pivotation of gate 22 rotationally upwardly about axis 36 between boundary walls 24, 26 on rise of water above elevation "E" buoyantly lifting gate 22.

Figure 7:
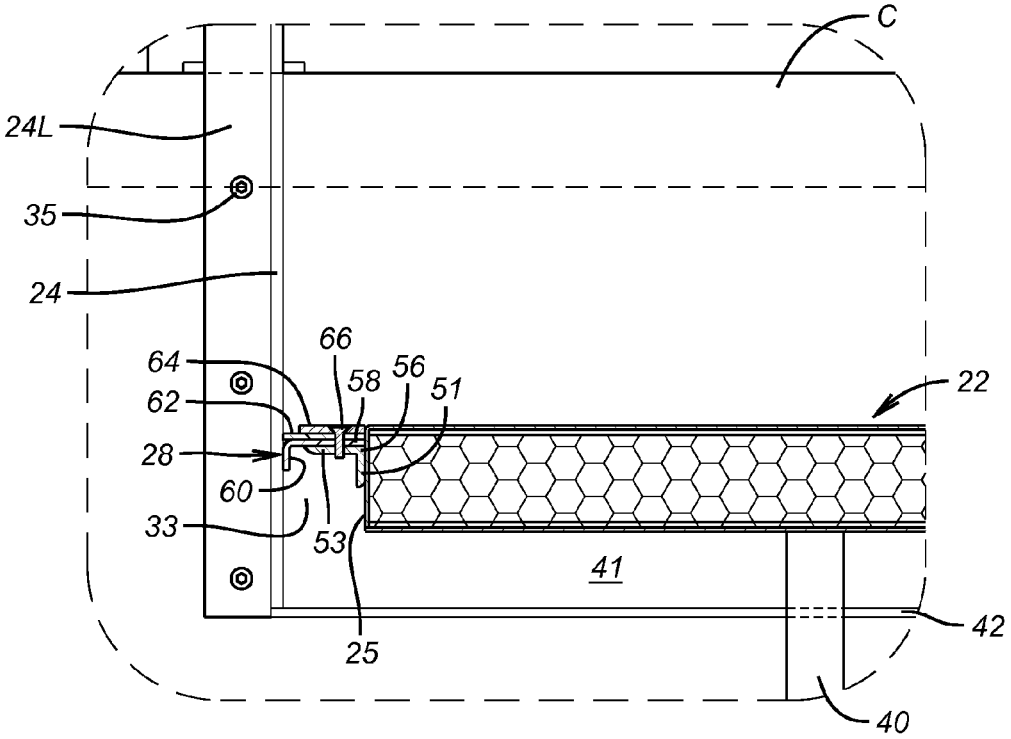
FIG. 7 is an enlargement of the portion of FIG. 5 indicated by dashed line outline and indicated by numeral 7.

Referring particularly to FIGS. 5 and 7, a third L-shaped flange 56 having a length the same as the length of lateral side 25 of gate 22 has a vertical leg 51 attached to side 25 of gate 22. A body portion 58 of a flexible L-shaped lip seal gasket 28 is positioned on a horizontal leg 53 of third L-shaped flange 56 along the length of flange 56 with a distal wiping lip portion 60 of gasket 28 directed away from bulkhead construction "C" and contacting boundary wall 26 along the lateral extent of the distal portion 60. A protective gasket 62 of the same length as lip seal gasket 28 is longitudinally positioned over gasket 28. A third flat band 64 having the same length as gasket 28 is arranged over protective gasket 62 longitudinally atop body 58 of gasket 28 on horizontal leg 53 of third flange 56. Threaded fasteners 66 pass consecutively through passages in third flat band 64, body 58 of gasket 28, and into drilled and tapped horizontal leg 53 of third L-shaped flange 56, connecting gasket 28 via flange 56 to the lateral side 25 of gate 22 to sealingly wipe boundary walls 26 and seal gap 33 adjacent side 25 and prevent passage of water through that gap 33.

The elements and arrangements for securing seal gasket 28 on side 27 of gate 22 are the same as for securing a gasket 28 on side 25 of gate 22 and identical reference numerals are used where the same details are visible in the drawings.

Referring to FIGS. 1, 5, 9 and 10, tension members 40 connected at one end to back face 72 of gate 22 are anchored at an opposite end to pilings 74 sunk in earth G for acting on gate 22 to prevent gate 22 from rotating about axis 36 more than a predetermined extent, as depicted vertically, when gate 22 is pivoted upwardly above elevation "E".

Referring to FIGS. 1 and 2, the series of contiguous flood guard units comprise a first end vertical boundary wall 26, a second end vertical boundary wall 24, and at least one vertical boundary wall located intermediate the end walls 26, 26'. A first end gate 22 is located between the first end wall 26 and a next adjacent intermediate boundary wall 24, and a second end gate 22' is located between the second end wall 26' and a next adjacent boundary wall 24.

The foregoing details exemplify the use of combinations of the described elements to defend against flood waters where the thing to be defended is at elevation spaced from ground. The disclosed subject matter is to be considered illustrative, and not restrictive, and the appended claims are intended to cover all modifications, enhancements, and other embodiments that fall within the true scope of the present invention, which to the maximum extent allowed by law, is to be determined by the broadest permissible interpretation of the following claims and their equivalents, unrestricted or limited by the foregoing detailed descriptions of exemplary embodiments of the invention.

I claim:

1. A series of self-actuating flood guard units, each unit comprising:

a buoyant gate having proximal, distal, and lateral sides, a height from the proximal to distal sides, and a width between the lateral sides, a first vertical boundary wall transversely connected at an end thereof to an existing upright wall construction running lengthwise along at least a portion of a shoreline of an adjacent body of water, said first boundary wall standing taller than said construction and extending over an adjacent near portion of said body of water, a second vertical boundary wall transversely connected at an end thereof to said construction, said second boundary wall standing taller than said construction and extending over an adjacent near portion of said body of water, longitudinally spaced from said first boundary wall a distance at least sufficient to accommodate the width of said gate, pivotation members comprising a stationary member horizontally and longitudinally connected to said construction and a moveable member moveably joined to said stationary member, said moveable member being connected to said proximal side of said gate and pivotable about a horizontal axis transverse to said boundary walls, said members locating said proximal side of the gate between said boundary walls at an elevation above ground inundated by said body of water selected to cause the said gate to rotationally buoyantly pivot upwardly about said axis between the boundary walls on a rise of said body of water at said shoreline, and at least one restraint acting on said gate and situated to prevent the gate from rotating about said axis more than a predetermined extent when the gate is pivoted upwardly above said elevation, said units being arranged side-by-side to act as a whole responsive to a rise of said body of water at said shoreline to prevent rising waters that otherwise would overtop said water wall construction from flooding the shore.

2. The series of flood guard units of claim 1 in which said series is continuous and comprises a plurality of said vertical boundary walls and a plurality of said gates, one said vertical boundary wall providing a first end wall to the series, another boundary wall providing a second end wall to the series, at least one boundary wall being located intermediate said end walls, a first end gate being located between the first end wall and a next adjacent intermediate boundary wall, and a second end gate being located between said second end wall and a next adjacent boundary wall.

3. The series of continuous self-actuating flood guard units of claim 2 in which said restraint comprises tension members attached to said gate and anchored in ground under said body of water adjacent said construction for acting on said gate to prevent the gate from rotating about said axis more than a predetermined extent when the gate is pivoted upwardly above said elevation, and in which the second vertical boundary wall connected to the construction is spaced from said first vertical boundary wall a distance wider than the width of the gate providing a gap between each lateral side of the gate and the adjacent boundary wall suitable for accommodation of a flexible lip seal gasket for sealing said gap, and further comprising flexible lip seal gaskets along the lateral sides of the gate and of width sufficient to sealingly wipe said boundary walls and seal said gaps to prevent passage of water through said gaps.

4. The series of flood guard units of claim 1 comprising a contiguous series of said units in which next adjacent boundary walls of a next adjacent unit are connected to a vertical support member connected to said construction.

5. The series of contiguous self-actuating flood guard units of claim 4 in which said restraint comprises tension members attached to said gate and anchored in ground under said body of water adjacent said construction for acting on said gate to prevent the gate from rotating about said axis more than a predetermined extent when the gate is pivoted upwardly above said elevation, and in which the second vertical boundary wall connected to the construction is spaced from said first vertical boundary wall a distance wider than the width of the gate providing a gap between each lateral side of the gate and the adjacent boundary wall suitable for accommodation of a flexible lip seal gasket for sealing said gap, and further comprising flexible lip seal gaskets along the lateral sides of the gate and of width sufficient to sealingly wipe said boundary walls and seal said gaps to prevent passage of water through said gaps.

6. The series of flood guard units of claim 1 in which said restraint comprises tension members attached to said gate and anchored in ground under said body of water adjacent said construction for acting on said gate to prevent the gate from rotating about said axis more than a predetermined extent when the gate is pivoted upwardly above said elevation.

7. The series of flood guard units of claim 1 in which said restraint is connected to the construction a distance above said horizontal axis allowing the gate to rotate to a substantially vertical orientation.

8. The series of self-actuating flood guard units of claim 1 in which the second vertical boundary wall connected to the construction is spaced from said first vertical boundary wall a distance wider than the width of the gate providing a gap between each lateral side of the gate and the adjacent boundary wall suitable for accommodation of a flexible lip seal gasket for sealing said gap, and further comprising flexible lip seal gaskets along the lateral sides of the gate and of width sufficient to sealingly wipe said boundary walls and seal said gaps to prevent passage of water through said gaps.

9. The series of self-actuating flood guard units of claim 8 further comprising a flexible strip gasket across the pivotation members along the proximal side of the gate to prevent passage of water between said construction and said proximal side of the gate.

10. The series of self-actuating flood guard units of claim 1 further comprising a brace spanning and connecting said vertical boundary walls at a foot of the walls distal from said horizontal axis.

* * * * *